US009532700B2

(12) United States Patent
Welch

(10) Patent No.: US 9,532,700 B2
(45) Date of Patent: Jan. 3, 2017

(54) DISHWASHER WITH OVERFLOW CONDUIT

(75) Inventor: Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1239 days.

(21) Appl. No.: 13/485,984

(22) Filed: Jun. 1, 2012

(65) Prior Publication Data

US 2013/0319483 A1 Dec. 5, 2013

(51) Int. Cl.

| | |
|---|---|
| ***A47L 15/02*** | (2006.01) |
| ***A47L 15/14*** | (2006.01) |
| ***A47L 15/42*** | (2006.01) |
| ***A47L 15/48*** | (2006.01) |

(52) U.S. Cl.

CPC ..... *A47L 15/421* (2013.01); *A47L 15/4208* (2013.01); *A47L 15/48* (2013.01); *A47L 2401/023* (2013.01); *A47L 2401/09* (2013.01); *A47L 2401/12* (2013.01); *A47L 2401/18* (2013.01); *A47L 2401/19* (2013.01); *A47L 2401/26* (2013.01); *A47L 2501/01* (2013.01); *A47L 2501/03* (2013.01); *A47L 2501/05* (2013.01); *A47L 2501/07* (2013.01); *A47L 2501/12* (2013.01); *A47L 2501/26* (2013.01); *A47L 2501/30* (2013.01)

(58) Field of Classification Search

CPC .... A47L 15/421; A47L 15/48; A47L 15/4208; A47L 2401/09; A47L 2501/03; A47L 2401/023; A47L 2401/12; A47L 2401/18; A47L 2401/19; A47L 2401/26; A47L 2501/01; A47L 2501/05; A47L 2501/07; A47L 2501/12; A47L 2501/26; A47L 2501/30

See application file for complete search history.

(56) References Cited

U.S. PATENT DOCUMENTS

| | | | |
|---|---|---|---|
| 1,617,021 | A | 2/1927 | Mitchell |
| 2,154,559 | A | 4/1939 | Bilde |
| 2,422,022 | A | 6/1947 | Koertge |
| 2,734,122 | A | 2/1956 | Flannery |
| 3,016,147 | A | 1/1962 | Cobb et al. |
| 3,026,628 | A | 3/1962 | Berger, Sr. et al. |
| 3,068,877 | A | 12/1962 | Jacobs |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

Ishihara et al., JP 11155792 A, English Machine Translation, 1999, pp. 1-14.

(Continued)

*Primary Examiner* — Michael Barr
*Assistant Examiner* — Benjamin L Osterhout

(57) ABSTRACT

A dishwasher for treating dishes according to at least one cycle of operation and having a tub at least partially defining a treating chamber and defining an access opening, a sprayer providing a spray of liquid into the treating chamber, a liquid recirculation system defining a recirculation flow path for recirculating the sprayed liquid from the treating chamber to the sprayer, and an air supply system having a conduit configured to function as an overflow conduit.

20 Claims, 5 Drawing Sheets

(56) References Cited

U.S. PATENT DOCUMENTS 3,103,227 A 9/1963 Long
3,122,148 A 2/1964 Alabaster
3,186,417 A 6/1965 Fay
3,288,154 A 11/1966 Jacobs
3,378,933 A 4/1968 Jenkins
3,542,594 A 11/1970 Smith et al.
3,575,185 A 4/1971 Barbulesco
3,586,011 A 6/1971 Mazza
3,739,145 A 6/1973 Woehler
3,801,280 A 4/1974 Shah et al.
3,846,321 A 11/1974 Strange
3,906,967 A 9/1975 Bergeson
3,989,054 A 11/1976 Mercer
4,179,307 A 12/1979 Cau et al.
4,180,095 A 12/1979 Woolley et al.
4,228,962 A 10/1980 Dingler et al.
4,326,552 A 4/1982 Bleckmann
4,754,770 A 7/1988 Fornasari
5,002,890 A 3/1991 Morrison
5,030,357 A 7/1991 Lowe
5,133,863 A 7/1992 Zander
5,331,986 A 7/1994 Lim et al.
5,454,298 A 10/1995 Lu
5,470,142 A 11/1995 Sargeant et al.
5,470,472 A 11/1995 Baird et al.
5,557,704 A 9/1996 Dennis et al.
5,569,383 A 10/1996 Vander Ark, Jr. et al.
5,618,424 A 4/1997 Nagaoka
5,630,437 A 5/1997 Dries et al.
5,711,325 A 1/1998 Kloss et al.
5,755,244 A 5/1998 Sargeant et al.
5,782,112 A 7/1998 White et al.
5,803,100 A 9/1998 Thies
5,865,997 A 2/1999 Isaacs
5,868,937 A 2/1999 Back et al.
5,904,163 A 5/1999 Inoue et al.
5,924,432 A 7/1999 Thies et al.
6,289,908 B1 9/2001 Kelsey
6,389,908 B1 5/2002 Chevalier et al.
6,443,091 B1 * 9/2002 Matte ..... A47L 15/421 116/228
6,460,555 B1 10/2002 Tuller et al.
6,491,049 B1 12/2002 Tuller et al.
6,601,593 B2 8/2003 Deiss et al.
6,666,976 B2 12/2003 Benenson, Jr. et al.
6,800,197 B1 10/2004 Kosola et al.
6,997,195 B2 2/2006 Durazzani et al.
7,047,986 B2 5/2006 Ertle et al.
7,069,181 B2 6/2006 Jerg et al.
7,093,604 B2 8/2006 Jung et al.
7,153,817 B2 12/2006 Binder
7,198,054 B2 4/2007 Welch
7,208,080 B2 4/2007 Batten et al.
7,232,494 B2 6/2007 Rappette
7,250,174 B2 7/2007 Lee et al.
7,270,132 B2 9/2007 Inui et al.
7,319,841 B2 1/2008 Bateman, III et al.
7,326,338 B2 2/2008 Batten et al.
7,347,212 B2 3/2008 Rosenbauer
7,350,527 B2 4/2008 Gurubatham et al.
7,363,093 B2 4/2008 King et al.
7,406,843 B2 8/2008 Thies et al.
7,445,013 B2 11/2008 VanderRoest et al.
7,497,222 B2 3/2009 Edwards et al.
7,523,758 B2 4/2009 VanderRoest et al.
7,594,513 B2 9/2009 VanderRoest et al.
7,819,983 B2 10/2010 Kim et al.
7,896,977 B2 3/2011 Gillum et al.
8,043,437 B1 10/2011 Delgado et al.
8,161,986 B2 4/2012 Alessandrelli
8,215,322 B2 7/2012 Fountain et al.
8,667,974 B2 3/2014 Fountain et al.
8,746,261 B2 6/2014 Welch
9,005,369 B2 4/2015 Delgado et al.
9,034,112 B2 5/2015 Tuller et al.
2002/0017483 A1 2/2002 Chesner et al.
2003/0037809 A1 2/2003 Favaro
2003/0168087 A1 9/2003 Inui et al.
2003/0205248 A1 11/2003 Christman et al.
2004/0007253 A1 1/2004 Jung et al.
2004/0103926 A1 6/2004 Ha
2004/0254654 A1 12/2004 Donnelly et al.
2005/0022849 A1 2/2005 Park et al.
2005/0133070 A1 6/2005 Vanderroest et al.
2006/0005863 A1 1/2006 Gurubatham et al.
2006/0054549 A1 3/2006 Schoendorfer
2006/0123563 A1 6/2006 Raney et al.
2006/0162744 A1 7/2006 Walkden
2006/0174915 A1 8/2006 Hedstrom et al.
2006/0236556 A1 10/2006 Ferguson et al.
2006/0237049 A1 10/2006 Weaver et al.
2006/0237052 A1 10/2006 Picardat et al.
2007/0006898 A1 1/2007 Lee
2007/0107753 A1 5/2007 Jerg
2007/0119478 A1 5/2007 King et al.
2007/0124004 A1 5/2007 King et al.
2007/0163626 A1 7/2007 Klein
2007/0186964 A1 8/2007 Mason et al.
2007/0246078 A1 10/2007 Purtilo et al.
2007/0266587 A1 11/2007 Bringewatt et al.
2007/0295360 A1 * 12/2007 Jerg ..... A47L 15/481 134/10
2008/0116135 A1 5/2008 Rieger et al.
2008/0289654 A1 11/2008 Kim et al.
2008/0289664 A1 11/2008 Rockwell et al.
2009/0095330 A1 4/2009 Iwanaga et al.
2009/0283111 A1 11/2009 Classen et al.
2010/0012159 A1 1/2010 Verma et al.
2010/0043826 A1 2/2010 Bertsch et al.
2010/0043828 A1 2/2010 Choi et al.
2010/0043847 A1 2/2010 Yoon et al.
2010/0121497 A1 5/2010 Heisele et al.
2010/0147339 A1 * 6/2010 Bertsch ..... A47L 15/22 134/56 D
2010/0154830 A1 6/2010 Lau et al.
2010/0154841 A1 6/2010 Fountain et al.
2010/0175762 A1 * 7/2010 Anacrelico ..... A47L 15/421 137/387
2010/0224223 A1 9/2010 Kehl et al.
2010/0252081 A1 10/2010 Classen et al.
2010/0300499 A1 12/2010 Han et al.
2011/0061682 A1 3/2011 Fountain et al.
2011/0120508 A1 5/2011 Yoon et al.
2011/0126865 A1 6/2011 Yoon et al.
2011/0146714 A1 6/2011 Fountain et al.
2011/0146730 A1 6/2011 Welch
2011/0146731 A1 6/2011 Fountain et al.
2012/0097200 A1 4/2012 Fountain
2012/0118330 A1 5/2012 Tuller et al.
2012/0118336 A1 5/2012 Welch
2012/0138096 A1 6/2012 Tuller et al.
2012/0138106 A1 6/2012 Fountain et al.
2012/0138107 A1 6/2012 Fountain et al.
2012/0291805 A1 11/2012 Tuller et al.
2012/0291822 A1 11/2012 Tuller et al.
2012/0318295 A1 12/2012 Delgado et al.
2012/0318296 A1 12/2012 Fountain et al.
2012/0318308 A1 12/2012 Fountain et al.
2012/0318309 A1 12/2012 Tuller et al.

FOREIGN PATENT DOCUMENTS

CN 2761660 3/2006
CN 1966129 5/2007
CN 2907830 6/2007
CN 101406379 4/2009
CN 201276653 7/2009
CN 201361486 12/2009
CN 101654855 2/2010
CN 201410325 2/2010
CN 201473770 5/2010
DE 1134489 8/1961
DE 1428358 A1 11/1968
DE 1453070 3/1969

(56) References Cited

FOREIGN PATENT DOCUMENTS

| | | | |
|---|---|---|---|
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |
| DE | 3842997 | A1 | 7/1990 |
| DE | 4011834 | A1 | 10/1991 |
| DE | 4016915 | A1 | 11/1991 |
| DE | 4131914 | A1 | 4/1993 |
| DE | 9415486 | U1 | 11/1994 |
| DE | 9416710 | U1 | 1/1995 |
| DE | 4413432 | C1 | 8/1995 |
| DE | 4418523 | A1 | 11/1995 |
| DE | 4433842 | | 3/1996 |
| DE | 69111365 | T2 | 3/1996 |
| DE | 19546965 | A1 | 6/1997 |
| DE | 69403957 | T2 | 1/1998 |
| DE | 19652235 | | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102010061215 | A1 | 6/2011 |
| DE | 102011052846 | A1 | 5/2012 |
| DE | 102012103435 | A1 | 12/2012 |
| EP | 0068974 | A1 | 1/1983 |
| EP | 0178202 | A1 | 4/1986 |
| EP | 0198496 | A1 | 10/1986 |
| EP | 0208900 | A2 | 1/1987 |
| EP | 0370552 | A1 | 5/1990 |
| EP | 0374616 | A1 | 6/1990 |
| EP | 0383028 | A2 | 8/1990 |
| EP | 0405627 | A1 | 1/1991 |
| EP | 437189 | A1 | 7/1991 |
| EP | 0454640 | A1 | 10/1991 |
| EP | 0521815 | A1 | 1/1993 |
| EP | 0585905 | A2 | 9/1993 |
| EP | 0702928 | A1 | 8/1995 |
| EP | 0597907 | B1 | 12/1995 |
| EP | 0725182 | A1 | 8/1996 |
| EP | 0748607 | A2 | 12/1996 |
| EP | 752231 | A1 | 1/1997 |
| EP | 0752231 | A1 | 1/1997 |
| EP | 0854311 | A2 | 7/1998 |
| EP | 0855165 | A2 | 7/1998 |
| EP | 0898928 | A1 | 3/1999 |
| EP | 1029965 | A1 | 8/2000 |
| EP | 1224902 | A2 | 7/2002 |
| EP | 1256308 | A2 | 11/2002 |
| EP | 1264570 | | 12/2002 |
| EP | 1319360 | A1 | 6/2003 |
| EP | 1342827 | | 9/2003 |
| EP | 1346680 | A2 | 9/2003 |
| EP | 1386575 | A1 | 2/2004 |
| EP | 1415587 | | 5/2004 |
| EP | 1498065 | A1 | 1/2005 |
| EP | 1583455 | A1 | 10/2005 |
| EP | 1703834 | A1 | 9/2006 |
| EP | 1743871 | A1 | 1/2007 |
| EP | 1862104 | A1 | 12/2007 |
| EP | 1882436 | A1 | 1/2008 |
| EP | 1980193 | A1 | 10/2008 |
| EP | 2127587 | A1 | 2/2009 |
| EP | 2075366 | A1 | 7/2009 |
| EP | 2138087 | A1 | 12/2009 |
| EP | 2332457 | A1 | 6/2011 |
| EP | 2335547 | A1 | 6/2011 |
| EP | 2338400 | A1 | 6/2011 |
| EP | 2351507 | A1 | 8/2011 |
| FR | 1370521 | A | 8/1964 |
| FR | 2372363 | A1 | 6/1978 |
| FR | 2491320 | A1 | 4/1982 |
| FR | 2491321 | A1 | 4/1982 |
| FR | 2790013 | A1 | 8/2000 |
| GB | 973859 | A | 10/1964 |
| GB | 1047948 | | 11/1966 |
| GB | 1123789 | A | 8/1968 |
| GB | 1515095 | | 6/1978 |
| GB | 2274772 | A | 8/1994 |
| JP | 55039215 | A | 3/1980 |
| JP | 60069375 | A | 4/1985 |
| JP | 61085991 | A | 5/1986 |
| JP | 61200824 | | 9/1986 |
| JP | 1005521 | A | 1/1989 |
| JP | 1080331 | A | 3/1989 |
| JP | 5245094 | A | 9/1993 |
| JP | 07178030 | | 7/1995 |
| JP | 10109007 | A | 4/1998 |
| JP | 2000107114 | A | 4/2000 |
| JP | 2001190479 | A | 7/2001 |
| JP | 2001190480 | A | 7/2001 |
| JP | 2003336909 | A | 12/2003 |
| JP | 2003339607 | A | 12/2003 |
| JP | 2004267507 | A | 9/2004 |
| JP | 2005124979 | A | 5/2005 |
| JP | 2006075635 | A | 3/2006 |
| JP | 2007068601 | A | 3/2007 |
| JP | 2008093196 | A | 4/2008 |
| JP | 2008253543 | A | 10/2008 |
| JP | 2008264018 | A | 11/2008 |
| JP | 2008264724 | A | 11/2008 |
| JP | 2010035745 | A | 2/2010 |
| JP | 2010187796 | A | 9/2010 |
| KR | 20010077128 | | 8/2001 |
| KR | 20090006659 | | 1/2009 |
| WO | 2005058124 | A1 | 6/2005 |
| WO | 2005115216 | A1 | 12/2005 |
| WO | 2007024491 | A2 | 3/2007 |
| WO | 2007074024 | A1 | 7/2007 |
| WO | 2008067898 | A1 | 6/2008 |
| WO | 2008125482 | | 10/2008 |
| WO | 2009018903 | A1 | 2/2009 |
| WO | 2009065696 | A1 | 5/2009 |
| WO | 2009077266 | A1 | 6/2009 |
| WO | 2009077279 | A2 | 6/2009 |
| WO | 2009077280 | A1 | 6/2009 |
| WO | 2009077283 | A1 | 6/2009 |
| WO | 2009077286 | A1 | 6/2009 |
| WO | 2009077290 | A1 | 6/2009 |
| WO | 2009118308 | A1 | 10/2009 |

OTHER PUBLICATIONS

German Search Report for Counterpart DE102014101260.7, Sep. 18, 2014.
European Search Report for EP12188007, Aug. 6, 2013.
German Search Report for DE102013103264, Jul. 12, 2013.
German Search Report for DE102013103625, Jul. 19, 2013.
German Search Report for DE102010061347, Jan. 23, 2013.
German Search Report for DE102010061215, Feb. 7, 2013.
German Search Report for Counterpart DE102013109125, Dec. 9, 2013.
European Search Report for EP11188106, Mar. 29, 2012.
German Search Report for DE102010061346, Sep. 30, 2011.
German Search Report for DE102010061343, Jul. 7, 2011.
German Search Report for DE102011053666, Oct. 21, 2011.
German Search Report for DE102010061342, Aug. 19, 2011.
European Search Report for EP101952380, May 19, 2011.

* cited by examiner

DISHWASHER WITH OVERFLOW CONDUIT

BACKGROUND OF THE INVENTION

Contemporary dishwashers for use in a typical household include a tub for receiving soiled dishes to be cleaned. A spray system and a recirculation system may be provided for recirculating liquid throughout the tub to remove soils from the dishes. The dishwasher may have a controller that implements a number of pre-programmed cycles of operation to wash dishes contained in the tub. A problem in such dishwashers is the overflow of liquid over a portion of the tub such that the liquid escapes the tub and leaks within the home.

SUMMARY OF THE INVENTION

An embodiment of the invention relates to a dishwasher for treating dishes according to at least one cycle of operation, the dishwasher having a tub at least partially defining a treating chamber and defining an access opening, a sprayer providing a spray of liquid into the treating chamber, a liquid recirculation system defining a recirculation flow path for recirculating the sprayed liquid from the treating chamber to the sprayer, and an air supply system having a blower, an air supply conduit having an outlet and configured to provide air to the treating chamber, and an air return conduit having an inlet and configured to remove air from the treating chamber. At least one of the air supply conduit outlet and the air return conduit inlet are located in a lower portion of the treating chamber. At least one of the air supply conduit and the air return conduit is configured to function as an overflow conduit to remove liquid from the treating chamber when the liquid is above a normal operating condition, which is indicative of an over fill event.

DESCRIPTION OF EMBODIMENTS OF THE INVENTION

Figure 1:
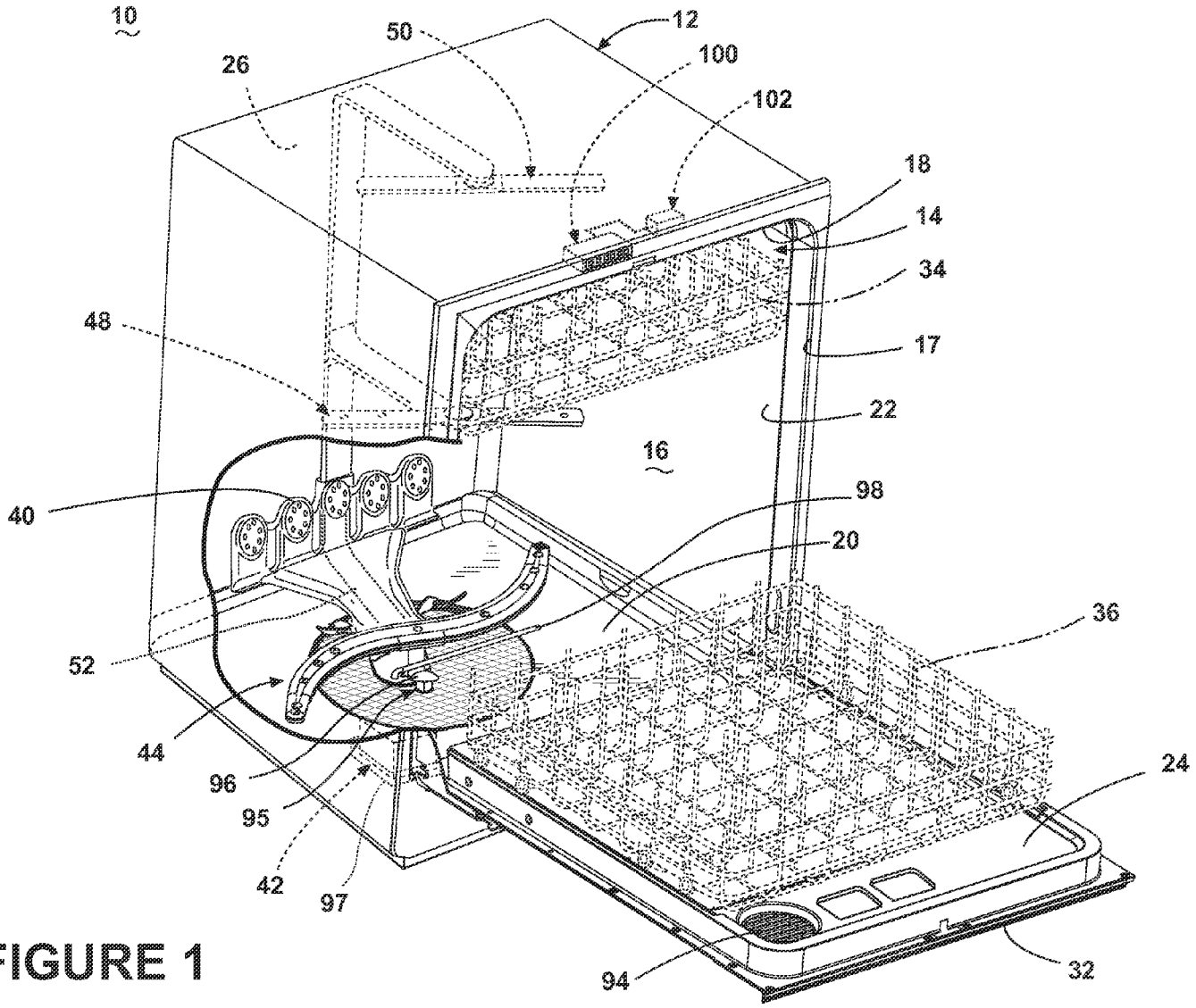
FIG. 1 is a perspective view of a dishwasher in accordance with a first embodiment of the invention.

Referring to FIG. 1, a first embodiment of the invention is illustrated as a dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional dishwasher, which will not be described in detail herein except as necessary for a complete understanding of the invention.

The cabinet 12 encloses a tub 14 at least partially defining a treating chamber 16 for holding dishes for washing according to a cycle of operation and defining an access opening

17. The tub 14 has spaced top and bottom walls 18 and 20, spaced sidewalls 22, a front wall 24, and a rear wall 26. In this configuration, the walls 18, 20, 22, 24, and 26 collectively define the treating chamber 16 for treating or washing dishes. The bottom wall 20 may have a front lip 28 (FIG. 2) with an upper portion 30 that may define a portion of the access opening 17. The front wall 24 may be at least partially defined by a door 32 of the dishwasher 10, which may be pivotally attached to the dishwasher 10 for providing accessibility to the treating chamber 16 through the access opening 17 for loading and unloading dishes or other washable items. More specifically, the door 32 may be configured to selectively open and close the access opening 17.

Dish holders in the form of upper and lower dish racks 34, 36 are located within the treating chamber 16 and receive dishes for washing. The upper and lower racks 34, 36 may be mounted for slidable movement in and out of the treating chamber 16 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware. While the present invention is described in terms of a conventional dishwashing unit as illustrated in FIG. 1, it could also be implemented in other types of dishwashing units such as in-sink dishwashers or drawer dishwashers including drawer dishwashers having multiple compartments.

Figure 2:
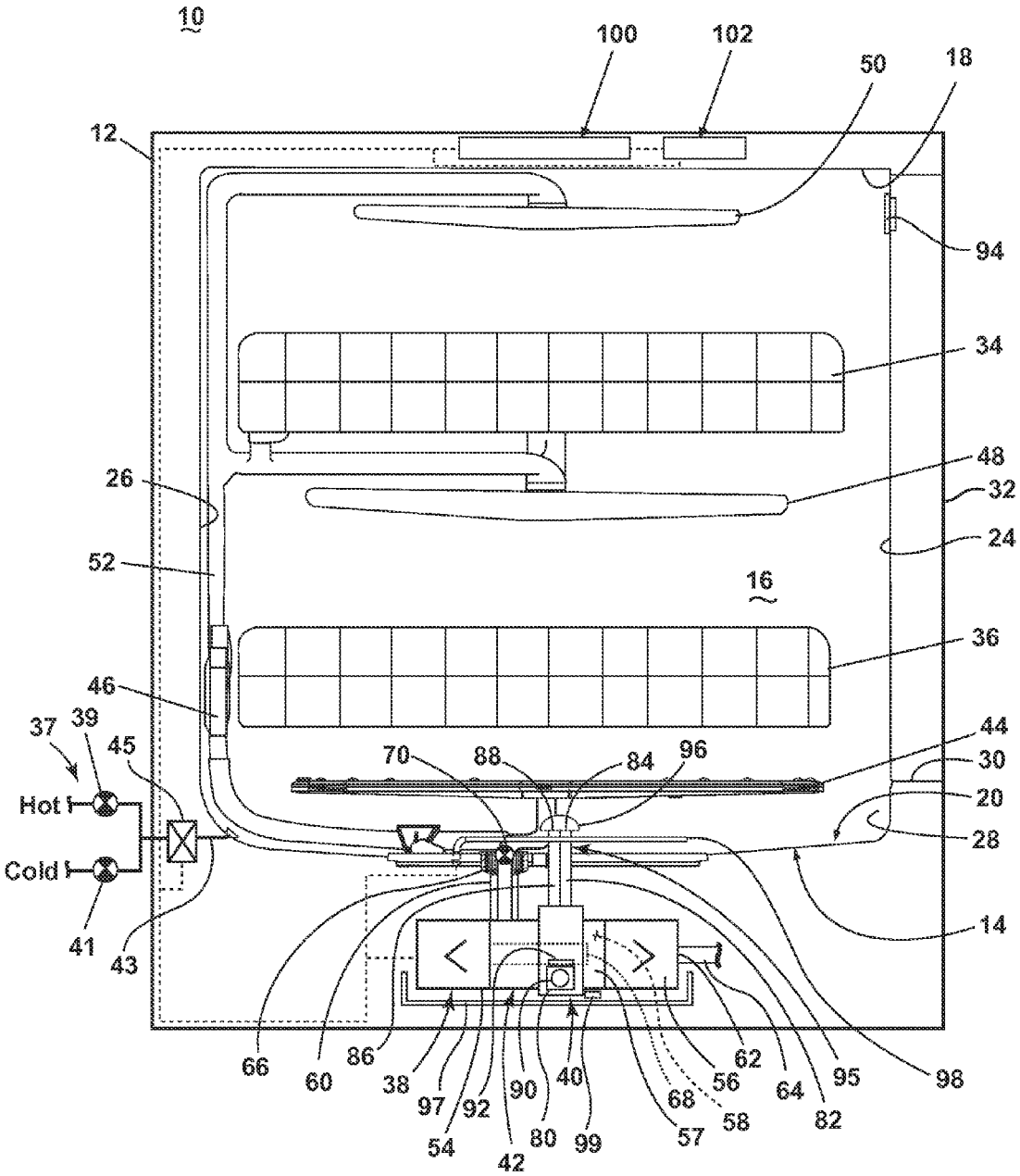
FIG. 2 is a partial schematic cross-sectional view of the dishwasher shown in FIG. 1 and illustrating a recirculation system and air supply system.

Referring to FIG. 2, the major systems of the dishwasher 10 and their interrelationship may be seen. For example, a liquid supply system for supplying liquid such as water to the dishwasher 10 is illustrated. The liquid supply system may include a liquid source, such as a household water supply 37, which may include separate valves 39 and 41 for controlling the flow of hot and cold water, respectively. Water may be supplied through an inlet conduit 43 directly to the tub 14 by controlling a fill valve mechanism 45, which may control the flow of water into the treating chamber 16.

Further, a liquid recirculation system 38 is provided for spraying liquid within the treating chamber 16 to treat any dishes located therein and an air supply system 40 is provided for supplying air to the treating chamber 16 for aiding in the drying of the dishes. The recirculation system may include a remote sump and filter unit 42 that is operably coupled to the liquid recirculation system 38 and the air supply system 40. Among other things, the remote sump and filter unit 42 may provide pumping and filtering for the liquid recirculation system 38, a heating function for the both the liquid recirculation system 38 and the air supply system 40, and a draining function.

The liquid recirculation system 38 may include one or more sprayers for spraying liquid within the treating chamber 16 and defines a recirculation flow path for recirculating the sprayed liquid from the treating chamber 16 to the one or more sprayers. As illustrated, there are four sprayers: a first lower spray assembly 44, a second lower spray assembly 46, a mid-level spray assembly 48, and an upper spray assembly 50, which may be supplied liquid from a supply tube 52. One or more valves may be provided with the supply tube 52 to control the flow of liquid to the various sprayers. In this way, liquid may be selectively supplied to a subset of all of the sprayers and/or simultaneously to all of the sprayers.

The first lower spray assembly 44 is positioned above the bottom wall 20 and beneath the lower dish rack 36. The first lower spray assembly 44 is an arm configured to rotate in the tub 14 and spray a flow of liquid from a plurality of spray nozzles or outlets, in a primarily upward direction, over a portion of the interior of the tub 14. A first wash zone may be defined by the spray field emitted by the first lower spray assembly 44 into the treating chamber 16. The spray from the first lower spray assembly 44 is sprayed into the tub 14 in typically upward fashion to wash dishes located in the lower dish rack 36. The first lower spray assembly 44 may optionally also provide a liquid spray downwardly onto a lower portion of the treating chamber 16, but for purposes of simplification, this will not be illustrated or described herein.

The second lower spray assembly 46 is illustrated as being located adjacent the lower rack 36 toward the rear of the treating chamber 16. The second lower spray assembly 46 is illustrated as including a horizontally oriented distribution header or spray manifold having a plurality of nozzles. The second lower spray assembly 46 may not be limited to this position; rather, the second lower spray assembly 46 could be located in virtually any part of the treating chamber 16. Alternatively, the second lower spray assembly 46 could be positioned underneath the lower rack 36, adjacent or beneath the first lower spray assembly 44. Such a spray manifold is set forth in detail in U.S. Pat. No. 7,594,513, issued Sep. 29, 2009, and titled "Multiple Wash Zone Dishwasher," which is incorporated herein by reference in its entirety. The second lower spray assembly 46 may be configured to spray a flow of treating liquid in a generally lateral direction, over a portion of the interior of the treating chamber 16. The spray may be typically directed to treat dishes located in the lower rack 36. A second wash zone may be defined by the spray field emitted by the second lower spray assembly 46 into the treating chamber 16. When both the first lower spray assembly 44 and the second lower spray assembly 46 emit spray fields the first and second zones may intersect.

The mid-level spray arm assembly 48 is positioned between the upper dish rack 34 and the lower dish rack 36. Like the first lower spray assembly 44, the mid-level spray assembly 48 may also be configured to rotate in the dishwasher 10 and spray a flow of liquid in a generally upward direction, over a portion of the interior of the tub 14. In this case, the spray from the mid-level spray arm assembly 48 is directed to dishes in the upper dish rack 34 to define a third spray zone. In contrast, the upper spray arm assembly 50 is positioned above the upper dish rack 34 and generally directs a spray of liquid in a generally downward direction to define a fourth spray zone that helps wash dishes on both upper and lower dish racks 34, 36.

The remote sump and filter unit 42 may include a wash pump or recirculation pump 54 and a drain pump 56, which are fluidly coupled to a housing 57 defining a sump 58, where liquid sprayed into the tub 14 will collect due to gravity. As illustrated, the housing 57 is physically separate from the tub 14 and provides a mounting structure for the recirculation pump 54 and drain pump 56. An inlet conduit 60 fluidly couples the tub 14 to the housing 57 and provides a path for the liquid in the treating chamber 16 to travel to the sump 58. As illustrated, the recirculation pump 54 fluidly couples the sump 58 to the supply tube 52 to effect a supplying of the liquid from the sump 58 to the sprayers. As illustrated, the drain pump 56 fluidly couples to a drain pump outlet 62 to effect a supplying of liquid from the sump to a household drain 64.

The inlet conduit 60, sump 58, recirculation pump 54, spray assemblies 44-50, and supply tube 52 collectively form a liquid flow path in the liquid recirculation system 38. A filter may be located somewhere within the liquid flow path such that soil and foreign objects may be filtered from the liquid. As an example, a filter 66 has been illustrated as being located inside the inlet conduit 60 such that soil and debris may be filtered from the liquid as it travels from an opening in the bottom wall 20 to the sump 58. The filter 66 may be a strainer, which may be employed to retain larger soil particles but allows smaller particles to pass through. An optional filter element 68 has been illustrated in FIG. 2 as being located within the housing 57 between the inlet conduit 60 and the recirculation pump 54.

The recirculation pump 54 may be fluidly coupled to the recirculation path such that it draws liquid in through the inlet conduit 60 and sump 58 and delivers it to one or more of the spray assemblies 44-50 through the supply tube 52. The liquid is sprayed back into the treating chamber 16 through the spray assemblies 44-50 and drains back to the sump 58 where the process may be repeated. Thus, a liquid flow path fluidly couples the treating chamber 16 to the spray assemblies 44-50. One or more valves or diverters, shown schematically as 70, may also be included in the dishwasher 10 to control the flow of liquid to the spray assemblies 44-50 from the recirculation pump 54. Further, while the supply tube 52 and valve 70 have been illustrated as being within the inlet conduit 60 it is contemplated that other configurations may be used.

The drain pump 56 may also be fluidly coupled to the housing 57. The drain pump 56 may be adapted to draw liquid from the housing 57 and to pump the liquid through a drain pump outlet 62 to a household drain 64. As illustrated, the dishwasher 10 includes a recirculation pump 54 and a drain pump 56. Alternatively, it is possible for the two pumps to be replaced by a single pump, which may be operated to supply to either the household drain or to the recirculation system.

The air supply system 40 may include a fan or blower 80, an air supply conduit 82 having an air supply conduit outlet 84 and an air return conduit 86 having an air return conduit inlet 88. The air supply conduit 82 may be configured to provide air to the treating chamber 16 while the air return conduit 86 may be configured to remove air from the treating chamber 16. It is contemplated that at least one of the air supply conduit outlet 84 and the air return conduit inlet 88 are located in a lower portion of the treating chamber 16 above the bottom wall 20. Further, while the air supply conduit 82 and the air return conduit 86 are illustrated as being located in the center of the bottom wall 20 and extending into the treating chamber 16, it is contemplated that they may be suitable located anywhere in the bottom wall 20 of the tub 14.

More specifically, the air supply conduit 82 and the air return conduit 86 are illustrated as being included in a standpipe 95 that extends through the bottom wall 20 of the tub into the treating chamber. A cover 96 or other means may be used to inhibit the entrance of sprayed liquid into the air supply conduit 82 and the air return conduit 86 by shielding the air supply conduit outlet 84 and the air return conduit inlet 88. Although both the air supply conduit 82 and the air return conduit 86 are illustrated in the standpipe 95, it is contemplated that alternatively only one of the air supply conduit 82 and the air return conduit 86 may be included in the standpipe 95. While both the air supply conduit outlet 84 and the air return conduit inlet 88 are illustrated as being at the same height it is contemplated that they may be located at different heights within the treating chamber 16.

It is contemplated that at least one of the air supply conduit outlet 84 and the air return conduit inlet 88 is below the upper portion 30 of the front lip 28 allowing the corresponding conduit to function as an overflow conduit to a container such as a base pan 97. More specifically, the base pan 97 may be fluidly coupled to one of the air supply conduit outlet 84 and the air return conduit inlet 88 to capture any liquid that may enter through the air supply conduit outlet 84 and the air return conduit inlet 88 during an overfill event. A float mechanism 99 may be located in the base pan 97 and configured to detect liquid in the base pan 97. The float mechanism 99 may be operably coupled to the valve 70 either directly or indirectly.

The air supply system may also include an inlet 90 located below the bottom wall 20 such that air exterior to the tub 14, i.e., "ambient air", may be provided to the treating chamber 16. A blower shutter 92 may be included and may be controlled such that a ratio of air from the inlet 90 and air from the air return conduit 86 may be controlled. In this manner, the blower 80 may be fluidly coupled to the inlet 90, as well as the air supply conduit 82 and the air return conduit 86 and the blower shutter 92 may control the ratio of the recirculated air and the ambient air provided to the treating chamber through the air supply conduit 82. Further, an air outlet, such as a vent 94, may be provided for exhausting the supplied air from the treating chamber 16. The vent 94 may be fluidly coupled to an outlet duct (not shown), which vents into the interior of the door 32 and will escape through the various openings in the door 32.

A heater 98 may be located in the treating chamber 16 near the bottom wall 20 to heat liquid in the treating chamber 16. Alternatively, or in addition to the heater 98, a heater 132 (FIG. 5) may be located on the housing 57 and the heater 132 may be configured to heat air in the air supply system 40 and the liquid in the liquid recirculation system 38.

A control panel or user interface 100 provided on the dishwasher 10 and coupled to a controller 102 may be used to select a cycle of operation. The user interface 100 may be provided on the cabinet 12 or on the outer panel of the door 32 and can include operational controls such as dials, lights, switches, and displays enabling a user to input commands to the controller 102 and receive information about the selected cycle of operation. The dishwasher 10 may further include other conventional components such as additional valves, a dispensing system for dispensing treating chemistries or rinse aids, spray arms or nozzles, etc.; however, these components are not germane to the present invention and will not be described further herein.

Figure 3:
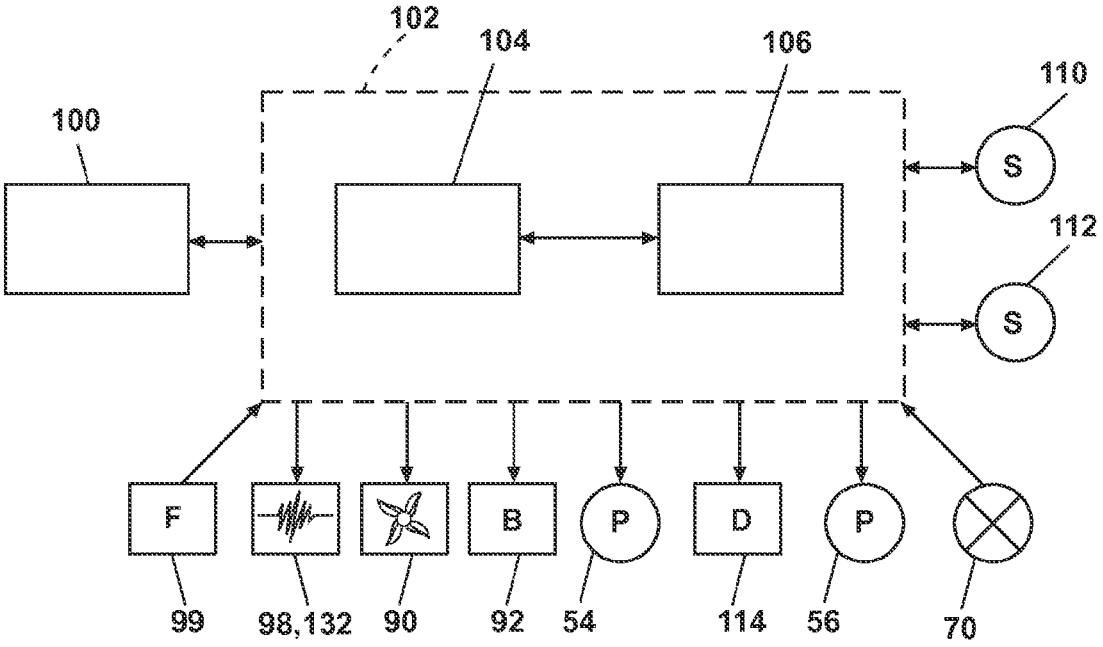
FIG. 3 is a schematic view of a control system of the dishwasher of FIG. 1.

As illustrated in FIG. 3, the controller 102 may be provided with a memory 104 and a central processing unit (CPU) 106. The memory 104 may be used for storing control software that may be executed by the CPU 106 in completing a cycle of operation using the dishwasher 10 and any additional software. For example, the memory 104 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 102 may be operably coupled with one or more components of the dishwasher 10 for communicating with and controlling the operation of the components to complete a cycle of operation. For example, the controller 102 may be coupled with the recirculation pump 54 for circulation of liquid in the tub 14 and the drain pump 56 for drainage of liquid in the tub 14. The controller 102 may also be operably coupled with the blower 80 and the blower shutter 92 to provide air into the tub 14. The controller 102 may also be operably coupled to the float mechanism 99, the fill valve mechanism 45, and the valve 70. The float mechanism 99 may output a signal to the controller 102 indicative of liquid in the base pan 97 and the controller 102 may operate the fill valve mechanism 45 and/or the valve 70 to stop the liquid recirculation.

Further, the controller 102 may also be coupled with one or more temperature sensors 110, which are known in the art and not shown for simplicity, such that the controller 102 may control the duration of the steps of the cycle of operation based upon the temperature detected. The controller 102 may also receive inputs from one or more other optional sensors 112, which are known in the art and not shown for simplicity. Non-limiting examples of optional sensors 112 that may be communicably coupled with the controller 102 include a moisture sensor, a door sensor, a detergent and rinse aid presence/type sensor(s). The controller 102 may also be coupled to a dispenser 114, which may dispense a detergent during the wash step of the cycle of operation or a rinse aid during the rinse step of the cycle of operation.

Figure 4:
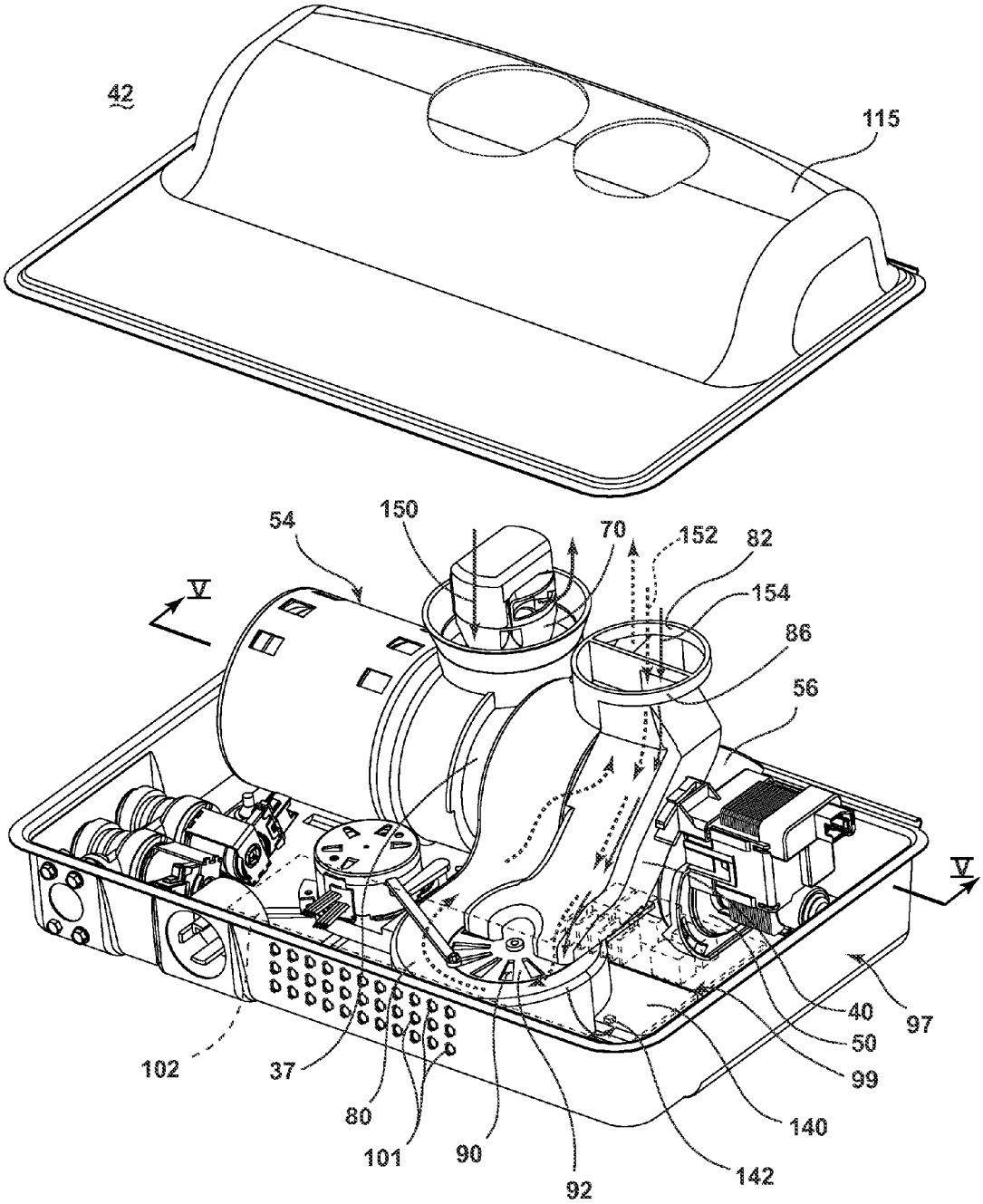
FIG. 4 is a perspective view of one embodiment of a remote sump and filter unit and its couplings to the recirculation system and air supply system illustrated in FIG. 2.

FIG. 4 illustrates a perspective view of one embodiment of the remote sump and filter unit 42. A cover 115 of the remote sump and filter unit 42 has been exploded from the remainder of the remote sump and filter unit 42 for clarity. The cover 115 may mount to the base pan 97 in any suitable manner. The base pan 97 may include louvers or openings 101 in the base pan 97 to allow ambient air into the container formed by the base pan 97 and the cover 115.

The remote sump and filter unit 42 has a drain pump 56 and recirculation pump 54 mounted to the housing 57. Portions of the air supply system 40 wrap around the housing 57. The blower 80 is mounted to the remote sump and filter unit 42 and includes the blower shutter 92, which may selectively control the ratio of air from the inlet 90 and the air return conduit 86 that may be provided to the treating chamber through the air supply conduit 82. The blower shutter 92 is illustrated as being operably coupled to a cam mechanism 93, which may be operably coupled to the controller 102 and may control the position of the blower shutter 92 and thus the ratio of air from the inlet 90 and the air return conduit 86. Such a cam mechanism 93 may be included in a drive system, which may also be operably coupled to the valve 70; such a drive system is set forth in detail in the application Ser. No. 13/486,038, entitled Dishwasher With Unitary Wash Module, filed concurrently herewith, and which is incorporated herein by reference in its entirety. It will be understood that only a portion of both the air supply conduit 82 and the air return conduit 86 are illustrated and that the remainder of the standpipe 95 has not been illustrated.

The float mechanism 99 may include any suitable float mechanism 99 and has been illustrated as including a floatable block 140 operably coupled to a float switch 142. The float switch 142 may output a signal to the controller 102 indicative of liquid in the base pan 97. In the illustrated embodiment of the remote sump and filter unit 42, the controller 102 may be associated with the remote sump and filter unit 42 and may be located within the base pan 97.

Figure 5:
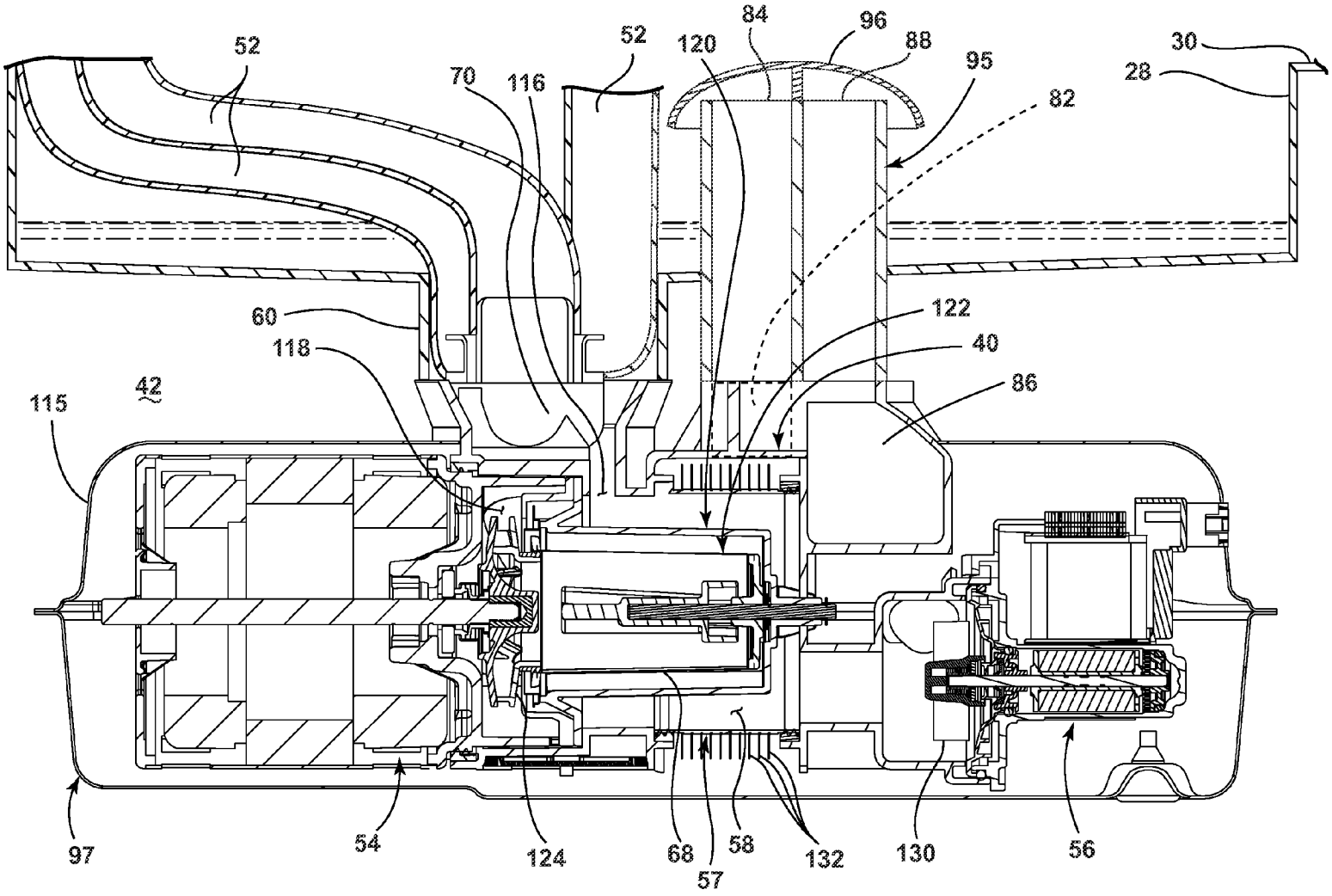
FIG. 5 is a cross-sectional view of the remote sump and filter unit of FIG. 4.

Referring to FIG. 5, a filter element 68 may be located in the housing 57 and fluidly disposed between the housing inlet 116 and housing outlet 118 to filter liquid passing through the sump 58. Because the housing 57 is located within the cabinet 12 but physically remote from the tub 14, the filter element 68 is not directly exposed to the tub 14. In this manner, the housing 57 and filter element 68 may be thought of as defining a filter unit, which is separate and remote from the tub 14. The filter element 68 may be a fine filter, which may be utilized to remove smaller particles from the liquid. The filter element 68 may be a rotating filter 68 utilizing a shroud 120 and a diverter 122 to aid in keeping the filter element 68 clean, such a rotating filter 68 and additional elements such as the shroud 120 and diverter 122 are set forth in detail in U.S. patent application Ser. No. 13/483,254, filed May 30, 2012, and titled "Rotating Filter for a Dishwasher," which is incorporated herein by reference in its entirety. The rotating filter according to U.S. patent application Ser. No. 13/483,254 may be operably coupled to an impeller 124 of the recirculation pump 54 such that when the impeller 124 rotates the filter element 68 is also rotated.

Liquid flows into the housing 57 through the housing inlet 116 and into the sump 58 where it may then be drawn through the filter element 68 and the recirculation pump 54 when the recirculation pump 54 is operated and pumped to the spray assemblies 44-50. In this manner, the filter element 68 fluidly separates the sump 58 from the inlet of the recirculation pump 54.

The drain pump 56 may also be fluidly coupled to the housing 57. The drain pump 56 includes an impeller 130 which may draw liquid from the housing 57 and pump it through a drain pump outlet 62 to a household drain 64 (FIG. 2). The filter element 68 is not fluidly disposed between the housing inlet 116 and the drain pump outlet 62 such that unfiltered liquid may be removed from the sump 58.

The housing 57 has been illustrated as being located inside a portion of the air supply system 40. The heater 132 may be operably coupled to the controller 102 and may be positioned such that it is mounted to the housing 57 and shared by the liquid recirculation system 38 and the remote sump and filter unit 42. More specifically, it has been illustrated that the heater 132 is mounted to an exterior of the housing 57 where the air supply system 40 wraps around the housing 57. In this location, the heater 132 may provide heated air and heated liquid into the tub 14 at the same time or may provide heated air and heated liquid into the tub 14 separately. Alternatively, it has been contemplated that the heater 132 may be mounted to an interior of the housing 57 or that portions of the heater 132 could be mounted on both the interior and the exterior of the housing 57. Any suitable heater may be used for the heater 132 including a coiled heater, multiple ring heater, or a film heater mounted on the housing 57, which has been illustrated by way of example.

During operation of the dishwasher 10, the liquid recirculation system 38 may be employed to provide liquid to one or more of the spray assemblies 44-50. Liquid in the tub 14 passes into the housing 57 where it may collect in the sump 58. At an appropriate time during the cycle of operation to spray liquid into the treating chamber 16, the controller 102 signals the recirculation pump 54 to supply liquid to one or more of the spray assemblies 44-50. The recirculation pump 54 draws liquid from the sump 58 through the filter element 68 and the recirculation pump 54 where it may then be delivered to one or more of the spray assemblies 44-50 through the supply tube 52 and any associated valving or diverters such as valve 70. A portion of the recirculation flow path in and out of the remote sump and filter unit 42 has been illustrated with arrows 150 (FIG. 4).

Regardless of whether the air is heated or not, the blower 80 may force air into the lower portion of the tub 14. The air travels upward within the treating chamber 16 and exits the treating chamber 16 through the vent 94 or is removed from the treating chamber 16 via the air return conduit 86. The blower 80 may draw in air from the air return conduit 86 and/or the inlet 90 depending upon the position of the blower shutter 92. A portion of the air flow path in and out of the remote sump and filter unit 42 has been illustrated with arrows 152 (FIG. 4). It has been contemplated that the air supply system 40 may be operated while the liquid recirculation system 38 is also being operated. It has also been contemplated that the air supply system 40 may be operated separately to form a drying portion of the operational cycle.

If during operation the tub 14 begins to overfill with liquid past a predetermined amount, then at least one of the air supply conduit 82 and the air return conduit 86 may function as an overflow conduit to remove liquid from the treating chamber 16. By way of non-limiting example, liquid has been schematically illustrated in FIG. 5 at the predetermined amount, which is indicative of a normal operating condition. In the illustrated embodiment, liquid above the air supply conduit outlet 84 or the air return conduit inlet 88 would be above the predetermined amount and would be indicative of an overfill event. As the base pan 97 is fluidly coupled to the at least one of the air supply conduit outlet 84 and the air return conduit inlet 88 either through the blower shutter 92 or the inlet 90 any liquid entering the air supply conduit outlet 84 and the air return conduit inlet 88 may enter into the base pan 97. A portion of the flow path of such overfill liquid has been schematically illustrated with arrows 154 (FIG. 4). In this manner, both the air supply conduit 82 and the air return conduit 86 may function as an overflow conduit to the base pan 97. As liquid in the base pan 97 increases the float mechanism 99, illustrated as the floatable block 140 may float and may activate the float switch 142. The float switch 142 may output a signal to the controller 102 indicative of liquid in the base pan 97 and the controller 102 may operate the valve 70 to stop the recirculation and the fill valve mechanism 45 to stop the addition of more liquid into the treating chamber and end the overfill event.

When the float mechanism 99 signals the controller 102 that there is water in the base pan 97, the controller 102 may then cease operation as long as there is water in the base pan 97. The controller 102 may then indicate that service needs to be called on the machine. This may be done by providing an audible indication or a visible indication on the user interface 100. It is contemplated that the washing machine 10 will remain inoperable until the water is lowered enough in the base pan 97 after service. Further, the controller 102 may store the occurrence of the overfill event as a fault in the memory 104 for later diagnostics.

The embodiments of the invention described above allow for portions of the air supply system to function as an overflow conduit to remove liquid from the treating chamber during an over fill event. This results in a simple construction, which requires fewer parts to manufacture the dishwasher. Further, the embodiments of the invention described above allow for a float mechanism to detect such an over fill event such that over fill event may be stopped. A benefit of the embodiments of the invention described above includes that any liquid past a predetermined point is directed to a container such that liquid will not overflow past the lip of the tub, under the door, and leak into the home of the user. Further, additional liquid is prevented from being supplied to the treating chamber. The prevention of the operation of the washing machine upon water being determined in the base pan also ensures that the machine will not be used until service has been provided, a determination for the overfill event has been made, and any required maintenance has taken place.

While the invention has been specifically described in connection with certain specific embodiments thereof, it is to be understood that this is by way of illustration and not of limitation, and the scope of the appended claims should be construed as broadly as the prior art will permit. For example, it has been contemplated that the invention may differ from the configurations shown in FIGS. 1-5, such as by inclusion of other conduits, dish racks, valves, spray assemblies, seals, and the like, to control the flow of liquid and the supply of air.

What is claimed is:

1. A dishwasher for treating dishes according to at least one cycle of operation, the dishwasher comprising:

a tub at least partially defining a treating chamber and defining an access opening;

a sprayer providing a spray of liquid into the treating chamber;

a liquid recirculation system defining a recirculation flow path for recirculating the sprayed liquid from the treating chamber to the sprayer; and an air supply system having a blower, an air supply conduit having an outlet and configured to provide air to the treating chamber, and an air return conduit having an inlet and configured to remove air from the treating chamber wherein at least one of the air supply conduit outlet or the air return conduit inlet are located in a lower portion of the treating chamber; and wherein the at least one of the air supply conduit or the air return conduit is fluidly open to the treating chamber such that it is configured to function as an overflow conduit to remove liquid from the treating chamber when the liquid is a predetermined amount above a normal operating condition, which is indicative of an over fill event.

2. The dishwasher of claim 1 wherein the at least one of the air supply conduit or the air return conduit comprises a standpipe that extends through a bottom wall of the tub into the treating chamber.

3. The dishwasher of claim 2 wherein the at least one of the air supply conduit outlet or the air return conduit inlet are located above the bottom wall of the tub.

4. The dishwasher of claim 1 wherein the tub further comprises a bottom wall having a front lip with an upper portion that at least partially defines a portion of the access opening.

5. The dishwasher of claim 4, further comprising a closure operable to selectively open and close the access opening.

6. The dishwasher of claim 5 wherein the at least one of the air supply conduit outlet or the air return conduit inlet is below the upper portion of the front lip allowing the corresponding conduit to function as an overflow conduit.

7. The dishwasher of claim 6, further comprising a base pan located outside the treating chamber and fluidly coupled to the at least one of the air supply conduit outlet or the air return conduit inlet.

8. The dishwasher of claim 7, further comprising a float mechanism located in the base pan and configured to detect liquid in the base pan during the over fill event.

9. The dishwasher of claim 8, further comprising a liquid supply system having a liquid source and a valve operably coupled to the liquid source to control the supply of liquid to the treating chamber.

10. The dishwasher of claim 9 wherein the float mechanism is operably coupled to the valve to stop the supply of liquid to the treating chamber when liquid is detected in the base pan.

11. The dishwasher of claim 10, further comprising a controller operably coupled to the float mechanism and the valve and wherein the float mechanism outputs a signal to the controller indicative of liquid in the base pan and the controller is configured to operate the valve to stop the supply of liquid.

12. The dishwasher of claim 11 wherein the float mechanism comprises a floatable block operably coupled to a float switch and where the float switch outputs a signal to the controller indicative of liquid in the base pan.

13. The dishwasher of claim 11, further comprising a valve operably coupled to the liquid recirculation system to stop the recirculation of the sprayed liquid from the treating chamber to the sprayer.

14. The dishwasher of claim 4 wherein the at least one of the air supply conduit or the air return conduit is located in a center of the bottom wall of the tub and extends into the treating chamber.

15. The dishwasher of claim 1, further comprising a remote sump and filter unit located exteriorly of the tub and comprising:

a housing defining a sump having a housing inlet fluidly coupled to a liquid outlet of the tub and a housing outlet fluidly coupled to the sprayer to define a liquid recirculation flow path from the sump to the sprayer;

a filter located within the sump and fluidly separating the housing inlet from the housing outlet to filter liquid recirculated through the sump; and a wash pump fluidly coupled to the recirculation flow path to pump the liquid from the sump to the sprayer.

16. The dishwasher of claim 15 wherein the air supply system further comprises a blower fluidly coupled with the air supply conduit to supply air to the tub and the blower is mounted to the remote sump and filter unit.

17. The dishwasher of claim 16, further comprising a heater located on the housing and wherein the heater is configured to heat air in the air supply system and the liquid in the liquid recirculation system.

18. The dishwasher of claim 15 wherein the filter is mounted to an impeller of the wash pump to effect rotation of the filter.

19. The dishwasher of claim 1, further comprising a door operably coupled to the tub and moveable to provide selective access to the tub through the access opening.

20. A dishwasher for treating dishes according to at least one cycle of operation, the dishwasher comprising:

a tub at least partially defining a treating chamber and defining an access opening;

a sprayer providing a spray of liquid into the treating chamber;

a liquid recirculation system defining a recirculation flow path for recirculating the sprayed liquid from the treating chamber to the sprayer;

an air supply system having a blower, an air supply conduit having an outlet and configured to provide air to the treating chamber, and an air return conduit having an inlet and configured to remove air from the treating chamber wherein at least one of the air supply conduit outlet or the air return conduit inlet are located in a lower portion of the treating chamber;

a base pan located outside the treating chamber and fluidly coupled to the at least one of the air supply conduit outlet or the air return conduit inlet; and a float mechanism located in the base pan and configured to detect liquid in the base pan during the over fill event; and wherein the at least one of the air supply conduit or the air return conduit is configured to function as an overflow conduit to remove liquid from the treating chamber when the liquid is a predetermined amount above a normal operating condition, which is indicative of an over fill event.

* * * * *